United States Patent [19]

Franzen et al.

[11] Patent Number: 5,028,777

[45] Date of Patent: Jul. 2, 1991

[54] METHOD FOR MASS-SPECTROSCOPIC EXAMINATION OF A GAS MIXTURE AND MASS SPECTROMETER INTENDED FOR CARRYING OUT THIS METHOD

[75] Inventors: Jochen Franzen; Reemt-Holger Gabling, both of Bremen; Gerhard Heinen, Grasberg; Gerhard Weiss, Weyhe, all of Fed. Rep. of Germany

[73] Assignee: Bruker-Franzen Analytik GmbH, Fed. Rep. of Germany

[21] Appl. No.: 285,741

[22] Filed: Dec. 16, 1988

[30] Foreign Application Priority Data

Dec. 23, 1987 [DE] Fed. Rep. of Germany ..... 3743718

[51] Int. Cl.[5] ..... H01J 49/42

[52] U.S. Cl. ..... 250/282; 250/291; 250/292

[58] Field of Search ..... 250/282, 291, 292

[56] References Cited

U.S. PATENT DOCUMENTS

| | | | |
|---|---|---|---|
| 3,527,939 | 9/1970 | Dawson . | |
| 4,540,884 | 9/1985 | Stafford et al. | 250/282 |
| 4,650,999 | 3/1987 | Fies et al. | 250/282 |
| 4,882,484 | 11/1989 | Franzen et al. | 250/282 |

FOREIGN PATENT DOCUMENTS 0202943 11/1986 European Pat. Off. .

OTHER PUBLICATIONS

"Zeitschrift für angewandte Physik", Rettinghaus, *Z. Angrew Phys.*, 1967, pp. 321–326.

*Primary Examiner*—Bruce C. Anderson

*Attorney, Agent, or Firm*—Cohn, Powell & Hind

[57] ABSTRACT

For mass-spectroscopic examinations of gas mixtures a mass spectrometer is used which comprises a quistor in which ions of the gas mixture whose charge-to-mass ratio is located in a predetermined range are stored by generating an electromagnetic field. By varying the field parameters, the ions are forced successively to leave the ion trap. The intensity of the ion flow leaving the ion trap is measured as a function of the variation of the field parameters. For improving the resolution, one uses a quistor of the type where the distance-related ratio Q of the radii of the inscribed vertex circles of the electrodes comply with the condition $Q \leqq 3.990$, wherein $$Q = \frac{R_e}{z_o} \times \frac{r_o}{R_r},$$

$R_e$ being the radius of the cross-section of the vertex of the end electrodes (3,5);

$R_r$ being the radius of the cross-section of the vertex of the annular electrode (4);

$z_o$ being the distance between the vertex of each end electrode (3,5) and the center of the quistor; and $r_o$ being the distance between the vertex of the annular electrode (4) and the center of the quistor.

3 Claims, 3 Drawing Sheets

METHOD FOR MASS-SPECTROSCOPIC EXAMINATION OF A GAS MIXTURE AND MASS SPECTROMETER INTENDED FOR CARRYING OUT THIS METHOD

The present invention relates to a method for mass-spectroscopic examination of a gas mixture using a mass spectrometer comprising an ion trap designed as quistor with an annular electrode and two end electrodes closing the chamber defined by the annular electrode, at least one of the said end electrodes being provided with a perforation forming the extension of the axis of rotation of the annular electrode, the method comprising the steps of:

applying to the annular electrode an rf voltage of an amplitude and frequency and, if necessary, a direct potential convenient to generate within the ion trap a three-dimensional rf quadrupole field suited to catch and store in the ion trap ions having a charge-to-mass ratio situated within a predetermined range;

introducing or generating ions of the gas mixture into, or in the ion trap and storing therein those ions whose charge-to-mass ratio is situated within the predetermined range;

varying at least one of the field parameters consisting of the amplitude, the frequency and, if applicable, the direct potential, in such a manner that ions whose charge-to-mass ratio varies monotonously become successively instable and leave the ion trap in the direction of the axis of rotation of its annular electrode and through the said perforation in the end electrode; and measuring and recording the intensity of the ion flow leaving the ion trap as a function of the variation of the field parameters.

Fundamental thoughts regarding the use of a quistor in mass spectrometry can be found in a book published by P.H. Dawson and entitled "Quadropole mass spectrometry and its applications", Amsterdam-Oxford-New York 1976, in particular on pages 181 to 190 and pages 203 to 219. The particular method which forms the starting point for the invention has been described by EP-OS 0 113 207. In the case of this known method, the limits of the range of the charge-to-mass ratio for which stable conditions prevail in the quistor, are displaced by varying the amplitude of the rf voltage so that the trapping conditions disappear successively for ions with increasing or else diminishing mass and the ions are permitted to leave the quistor in the direction of the axis of rotation of the annular electrode. The ions leaving the quistor are registered by means of an electron multiplier in order to derive the spectrum of the gas sample contained in the quistor.

It is a particular characteristic of the quistor that in the center of the rf field the ions are not exposed to a field strength that would impart to them a motion component inducing them to leave the ion trap. In order to remedy this inconvenience, one introduces into the ion gap a collision gas whose pressure is adjusted in such a manner that an optimum number of collisions will expel the ions from the central area of the ion trap far enough to permit them to leave the ion trap. Given the fact that this gas acts simultaneously to increase the yield by damping the ion movement in a direction transverse to the direction of expulsion, this gas is also known as "damping gas".

The design of all embodiments of the ion trap that have become known heretofore all follow the so-called "ideal" quistor. The design of such an "ideal" quistor comprises an annular electrode in the form of a hyperbolic toroid and two rotational-hyperbolic end electrodes, the asymptotic angle of the hyperbolas being exactly equal to $1:\sqrt{2}$. A quistor of this design distinguishes itself by the fact that the ion traps in the quistor can be computed by solving Matthieu's differential equations. However, it has not been possible heretofore to compute the ion paths for other designs of the ion trap. Indeed, it has not even been possible heretofore to compute the exact potential distributions in ion traps of different shapes so as to enable the movements to be computer-simulated with tolerable rapidity.

The results obtained with these "ideal" ion traps show that during recording of the spectra, under optimum pressure conditions of the damping gas and optimum scanning conditions, it takes approx. 200 periods of the rf voltage for approx. 95% of the ions to leave the ion trap. The lineshape, therefore, shows initially a steep rise up to a maximum value, followed by a slow tailing line, which is adverse to an optimum resolution of the spectrum.

The lineshape is further affected by space-charge effects when an excessive number of ions is present in the quistor. As can be derived from a paper by J.W. Eichelberger et al published in "Analytical Chemistry" 59, page 2732, 1987, this space-charge effect even leads increasingly to scientific misinterpretations.

Now, it is the object of the present invention to develop a method of the type described at the outset in such a manner as to achieve an improvement of the lineshape and, accordingly, an improvement of the resolution in mass-spectroscopic examinations of gas mixtures carried out with the aid of such a mass spectrometer.

This object is achieved according to the invention by the fact that for carrying out the method a quistor is used in which the distance-related ratio Q of the radii of the inscribed vertex circles of the electrodes comply with the condition $Q \leqq 3.990$, wherein $$Q = \frac{R_e}{z_o} \times \frac{r_o}{R_r},$$

$R_e$ being the radius of the cross-section of the vertex of the end electrodes;

$R_r$ being the radius of the cross-section of the vertex of the annular electrode;

$z_o$ being the distance between the vertex of each end electrode and the center of the quistor; and $r_o$ being the distance between the vertex of the annular electrode and the center of the quistor.

In the case of the before-described "ideal" quistor, the distance-related ratio Q of the radii of the inscribed vertex circles of the electrodes is exactly equal to the value $Q=4$. Surprisingly, the mass-selective ejection of the ions achieved by rendering the ion tracks sequentially instable can be improved decisively by reducing the ratio Q to a value of $Q \leqq 3.990$. For, it has been accepted as a matter of course heretofore that the "ideal" quistor distinguishes itself not only by its calculability, but provides also ideal conditions regarding its storing capacities and its other behavior. So, it has been known for example from the book by Dawson mentioned before that so-called cumulative resonances of the ion movements in the quistor which lead to storage losses are due to extraordinarily slight deviations of the quistor configuration from the "ideal" shape.

The measure according to the invention not only reduces the period of time required by the ions for leaving the trap, but also improves the lineshape, increases the sensitivity and the detection power by improving the signal-to-noise ratio, and reduces the influence of the space-charge. The reduction of the period of time which the ions need for leaving the ion trap makes it possible to map out the spectra more often per time unit which increases the sensitivity even further.

The effect of the measure proposed by the invention may be explained by the fact that the potential having the strongest effect on the ions in the quistor is the one present on those points of the electrodes which are the closest to the center, i.e. the storage space for the ions. These points are the vertex points of the end electrodes and the vertex line of the annular electrode. In the case of hyperbolic electrodes, these points exhibit simultaneously the smallest radius of curvature. Consequently, the behavior of the quistor is influenced decisively by the ratios between the radii of curvature of the electrodes at the vertex points and the distances of these vertex points, as expressed by the ratio Q defined above, which may also be shortly described as distance-related circle ratio. It must be noted in this connection that even relatively slight deviations from the ratio $Q=4.000$ existing in an ideal quistor have already a great effect.

The present invention further relates to a mass spectrometer suited for examining a gas mixture according to the method proposed by the invention and comprising an ion trap designed as quistor with an annular electrode and two end electrodes closing the chamber defined by the annular electrode, at least one of the said end electrodes being provided with a perforation forming the extension of the axis of rotation of the annular electrode. In the case of this mass spectrometer, the distance-related ratio Q of the radii of the inscribed vertex circles of the electrodes comply again with the condition $Q \leqq 3.990$, wherein $$Q = \frac{R_e}{z_o} \times \frac{r_o}{R_r},$$

$R_e$ being the radius of the cross-section of the vertex of the end electrodes;

$R_r$ being the cross-section of the vertex of the annular electrode;

$z_o$ being the distance between the vertex of each end electrode and the center of the quistor; and $r_o$ being the distance between the vertex of the annular electrode and the center of the quistor.

The relationship described before permits numerous design variations. According to a preferred embodiment of the invention, the dimensions of the quistor which determine the distance-related ratio Q, are selected in such a manner that the distance $r_o$ of the vertex of the annular electrode from the center of the quistor is equal to a value which guarantees that the greatest interesting mass is still trapped by the storage field, at the amplitude of the rf voltage applied to the annular electrode, the distance $z_o$ of the vertex points of the end electrodes from the center of the quistor is equal to Q $z_o=r_o/4\sqrt{Q}$, for a given ratio Q, and the radii $R_e$ and $R_r$ of the vertex cross-sections are selected in such a manner that $R_e \times R_r = r_o \times z_o$. It results that when the quistor is designed in this manner, the values $r_o$ and Q Which are particularly important for the behavior of the quistor, are preselected and the other values are determined by applying the described rules, it being understood that in selecting $R_e$ and $R_r$ one has certain liberties enabling other influences to be taken into consideration, such as certain production parameters. It goes without saying that the relations described above are to be understood only as a guideline and that it is by no means imperative, though convenient, that these relations be adhered to, which means that deviations from these guidelines are absolutely permissible.

The invention will now be described and explained in more detail with reference to the embodiment illustrated in the drawing. The features which can be derived from the drawing and the specification may be used in other embodiments of the invention either individually or in any combination thereof. In the drawing FIG. 1 shows a diagrammatic representation of a cross-section through a quistor designed according to the invention;

Figure 1:
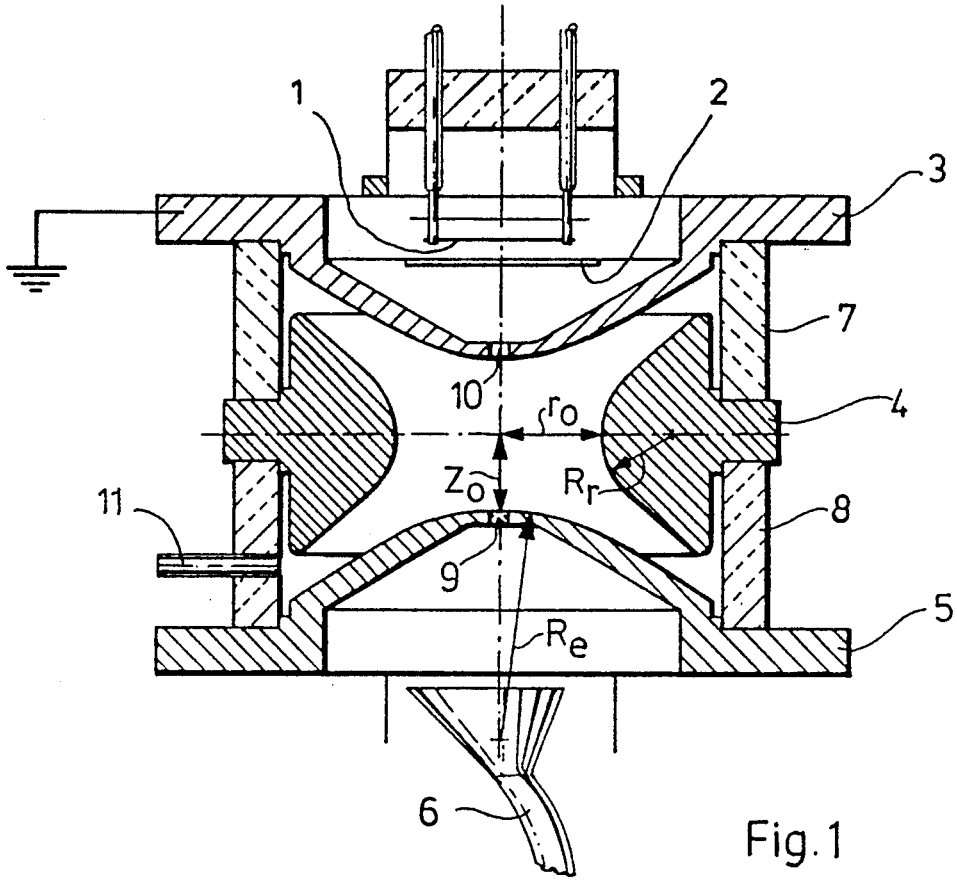

The quistor illustrated in FIG. 1 comprises an annular electrode 4 and two end electrodes 3, 5 arranged respectively on either end of the annular electrode and closing the chamber defined by the annular electrode 4, at the two ends thereof. Each of the end electrodes 3 and 5 is supported on the annular electrode 4 by an annular insulator 7, 8. The annular insulators 7, 8 establish at the same time a tight connection between the outer portions of the annular electrode 4 and the end electrodes 3, 5. An inlet line 11 opening into the annular insulator 8 enables a damping gas to be introduced into the ion trap. The upper end electrode 3—as viewed in FIG. 1—comprises a central opening 10. A hot cathode 1 intended for generating an electron beam, and a blocking lens 2 intended for controlling the electron beam, are arranged outside the end electrode 3, opposite the opening 10. The lower end electrode 5—as viewed in FIG. 1—is provided in its central area with a perforation 9 forming a passage for the ions leaving the quistor. A secondary electron multiplier 6 arranged at the outside of the lower end electrode 5 serves for detecting the ions leaving the quistor through the perforation 9.

Figure 2:
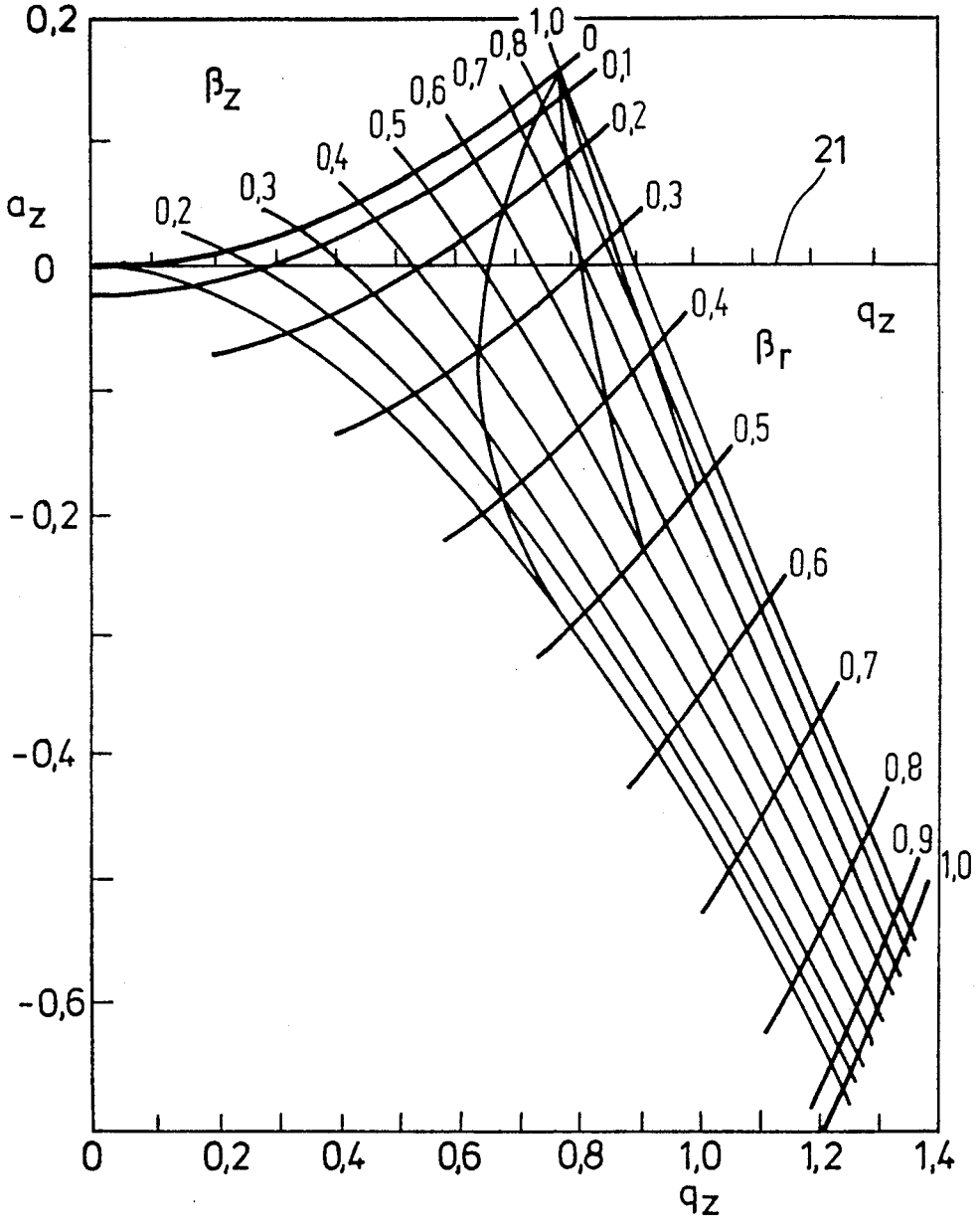
FIG. 2 shows the stability diagram of the quistor of FIG. 1.

Both the annular electrode 4 and the end electrodes 3 and 5 have strictly hyperbolic surfaces which means that their contours as shown by the cross section illustrated in FIG. 1 represent hyperbolas. The asymptotic angle of the hyperbolas of both the annular electrode 4 and the end electrodes 3, 5 is equal to 1:1.360. The inner radius $r_o$ of the annular electrode amounts to 1.00 cm. The other dimensions are selected in such a manner that the distance-related ratio Q described above is equal to $Q=3.422$, i.e. clearly below $Q=4.000$. While the end electrodes 3, 5 are connected to mass potential, an rf voltage of a frequency of 1.0 MHz, which can be varied within the range of 0 V to 7.5 kV, is applied to the annular electrode 4. When the voltage is equal to 7.5 kV, the range of the charge-to-mass ratio of the ions which are trapped and stored by the quistor, with simple ionization, includes ions having the mass numbers 1 to 500u, u being the atomic mass unit. Accordingly, a mass range of 1u to 500u may be covered by a single scan, by varying the rf voltage in the range from 0 V to 7.5 kV. The stability diagram characteristic of this condition is illustrated in FIG. 2. This diagram shows a proportional development of the coordinate values q of the field strength V/m of the alternating field and the coordinate values a of the field strength U/m of the constant field. As in the case of the quistor shown by way of example the direct voltage U has the value U=0, the stability range is run through along line 21 as the rf voltage is varied.

The means for generating an electron beam, with which the quistor according to FIG. 1 is equipped, enables the ions to be generated in the quistor itself by focusing an electron beam from a hot cathode 1 through the opening 10 into the quistor during the ionization phase whose length can be determined by means of the blocking lens 2. Typical ionization periods for an electron beam of 100 μA are, for example, in the range of 10 μs to 100 ms, depending on the concentration to the substance to be examined.

Figure 3:
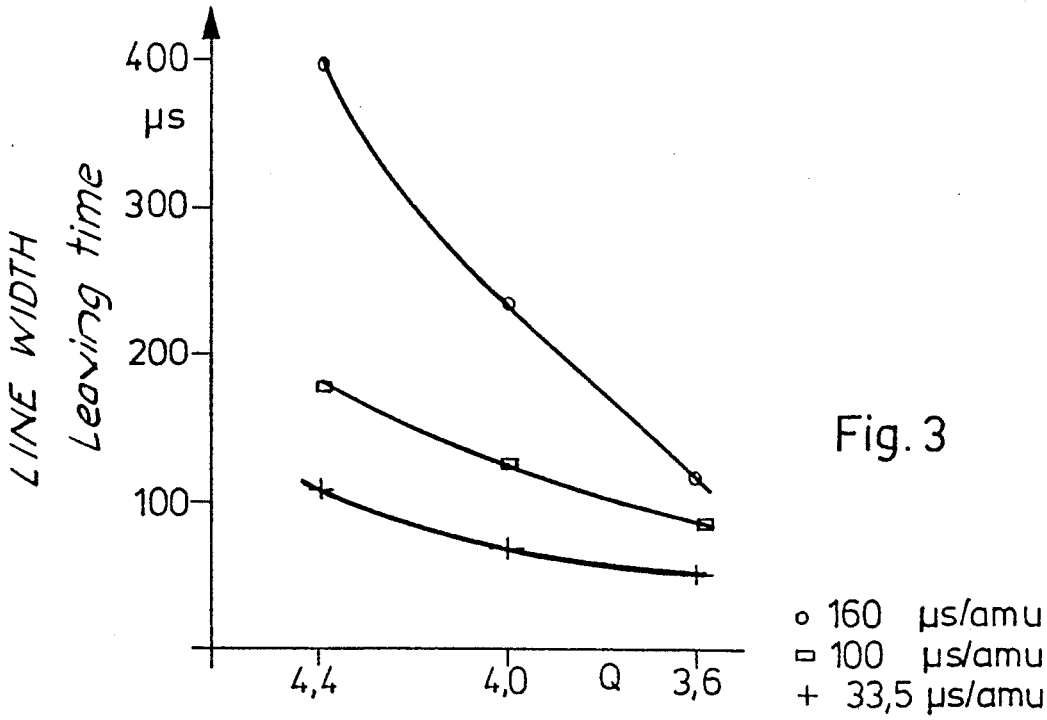
FIG. 3 shows a diagram of the time required by the ions for leaving the quistor, plotted as a function of the ratio Q for the three different scanning speeds.

The diagram of FIG. 3 illustrates the time which the ions require for leaving the quistor and which is expressed, accordingly, as line width, plotted as a function of the distance-related circle ratio Q. The three curves of the diagram of FIG. 3 correspond to different scanning speeds, as indicated at the bottom line of FIG. 3. During the test, damping gas was used under pressure conditions adapted optimally to the particular case. It will be readily seen that the resolution increases considerably for Q<4.000.

Figure 4:
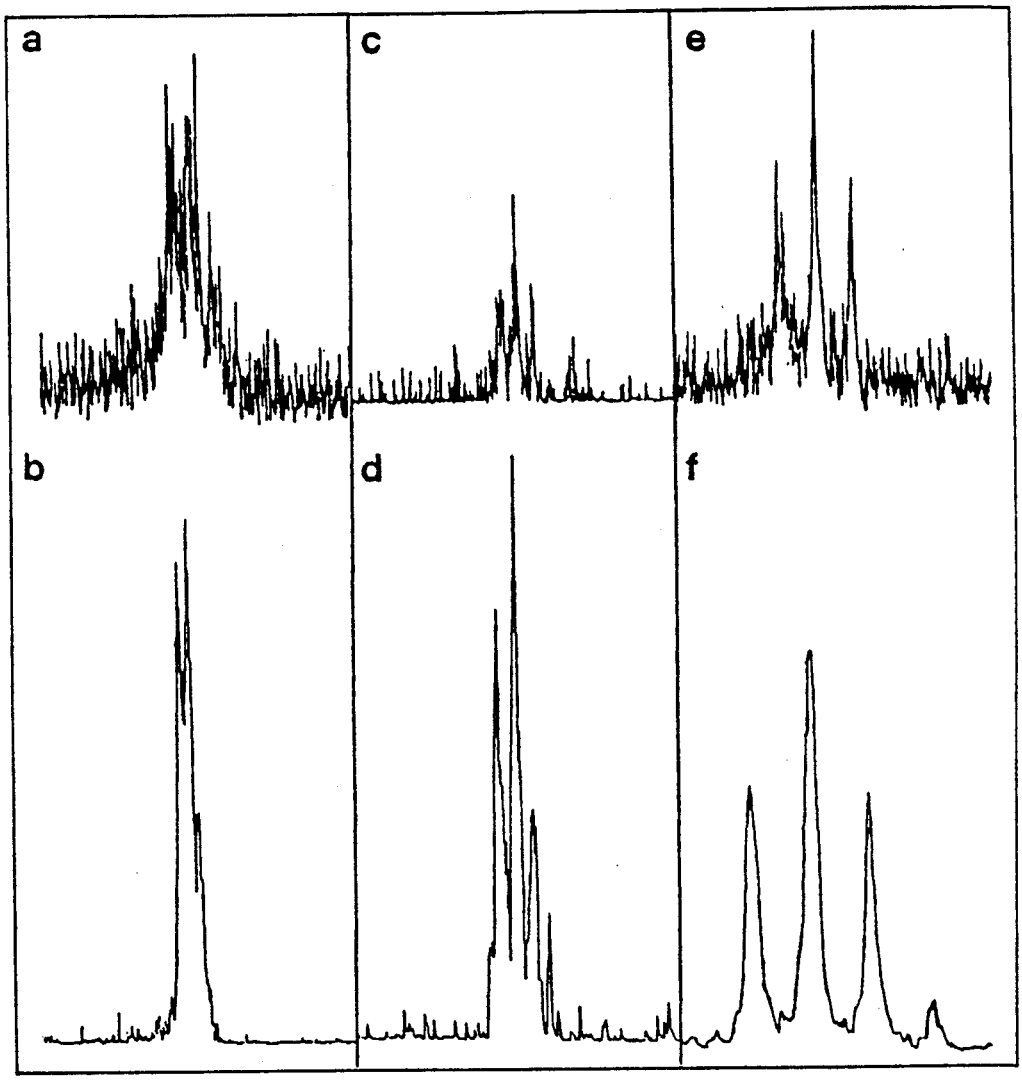
FIG. 4 shows diagrams of the spectra recorded under different conditions.

FIG. 4 shows the spectrum of the group of molecule ions of tetrachlorethene, for different values of the distance-related circle ratio Q. The spectra were recorded at different scanning speeds over 300 mass units each, using air at a pressure of $4.10^{-4}$ mbar as damping gas. The scanning time for each of the upper spectra a, c and e was 100 ms, while the scanning time for each of the lower spectra b, d and f was 20 ms. The spectra a and b were recorded in a quistor with a distance-related circle ratio of Q=4.4, the middle spectra c and d in a quistor of the ratio Q=4.0 and, finally, the right spectra e and f in a quistor having the ratio Q=3.6. The quistors used had the dimensions (in cm) resulting from the following table:

| | | | |
|---|---|---|---|
| Q | 3.6 | 4.0 | 4.4 |
| $r_o$ | 1 | 1 | 1 |
| $z_o$ | 0.7260 | 0.7071 | 0.6905 |
| $R_r$ | 0.5269 | 0.5000 | 0.4768 |
| $R_e$ | 1.3776 | 1.4142 | 1.4482 |

Of the above dimensions, the distance $r_o$ determines the field strength V/m of the alternating field and, accordingly, the highest mass that can be recorded by a single scan, for a given amplitude of the rf voltage applied to the annular electrode. This value, which was fixed under these aspects at $r_o=1$ cm, invariably for all three quistors, permitted the before-mentioned scan over 300 mass units each. The values of $z_o$ were determined by the formula $z_o=r_o/r^{\circ}Q$, while $R_e$ and $R_r$ were selected in such a manner that $R_e \times R_r = r_o \times z_o$.

The dramatic improvement of the resolution and the signal-to-noise ratio between the spectra according to FIG. 4*a* and FIG. 4*f* underlines the important technological progress achieved by the invention. It should be especially noted in this connection that the increase of the scanning speed, which enables the distance-related circle ratio Q to be reduced to values of Q<4.000, leads at the same time to a superproportional increase of the signal-to-noise ratio and, consequently, to a considerably improved resolution.

Another advantage is seen in the fact that the influence of the space-charge is also considerably reduced for values of Q<4.000. Even with signal strengths reduced by the factor 100, no notable change of the line shape and line width could be observed.

The reason for the improvements observed lies in the development of a resonance of the secular movement of the ions, exactly at the limit of instability, which accelerates the rise in amplitude of the secular movement and increases consequently the speed of ion ejection. Consequently, the ejection is due only partly to the paths becoming instable, and partly also to the additional accumulation of energy by the ions from the storing rf field, which is rendered possible by the resonance.

Negative influences by resonance phenomena have never been observed so long as the process is carried out substantially without the application of a direct-voltage field. Consequently, a preferred embodiment of the invention provides that no direct-voltage field is used. In principle, however, it would be possible also to use a direct-voltage field and to vary the latter for the purpose of varying the stability range.

It is understood that the invention is not limited to the described embodiment, but that numerous deviations are possible without leaving the scope and intent of the invention. In particular, it is possible to use a plurality of different quistors whose dimensions can be modified in the most various ways, so long as the condition is fulfilled that the distance-related circle ratio Q must be smaller than or equal to 3.990.

We claim:

1. A method for mass-spectroscopic examination of a gas mixture using a mass spectrometer comprising an ion trap designed as quistor with an annular electrode defining a chamber and two end electrodes closing the chamber defined by the annular electrode, at least one of the said end electrodes being provided with a perforation forming the extension of the axis of rotation of the annular electrode, the method comprising the steps of:

applying to the annular electrode an rf voltage of am amplitude and frequency and, if necessary, a direct potential convenient to generate within the ion trap a three-dimensional rf quadrupole field suited to catch and store in the ion trap ions having a charge-to-mass ratio situated within a predetermined range;

introducing or generating ions of the gas mixture into, or in the ion trap and storing therein those ions whose charge-to-mass ratio is situated within the predetermined range;

varying at least one of the field parameters consisting of the amplitude, the frequency and, if applicable, the direct potential, in such a manner that ions whose charge-to-mass ratio varies monotonously become successively instable and leave the said ion trap in the direction of the axis of rotation of its annular electrode and through the said perforation in the said end electrode; and measuring and recording the intensity of the ion flow leaving the ion trap as a function of the variation of the field parameters, characterized in that for carrying out the method a quistor is used in which the distance-related ration Q of the radii of the inscribed vertex circles of the electrodes comply with the condition $Q \leqq 3.990$, wherein $$Q = \frac{R_e}{z_o} \times \frac{r_o}{R_r}$$

$R_e$ being the radius of the cross-section of the vertex of the said end electrodes;

$R_r$ being the radius of the cross-section of the vertex of the said annular electrode;

$z_o$ being the distance between the vertex of each said end electrode and the center of the said quistor; and $r_o$ being the distance between the vertex of the said annular electrode and the center of the said quistor.

2. A mass spectrometer comprising an ion trap designed as quistor with an annular electrode defining a chamber and two end electrodes closing the chamber defined by the annular electrode, at least one of the end electrodes being provided with a perforation forming the extension of the axis of rotation of the annular electrode, suited for examination of a gas mixture, characterized in that the distance-related ratio Q of the radii of the inscribed vertex circles of the electrodes comply with the condition $Q \leqq 3.990$, wherein $$Q = \frac{R_e}{z_o} \times \frac{r_o}{R_r}$$

$R_e$ being the radius of the cross-section of the vertex of the said end electrodes;

$R_r$ being the radius of the cross-section of the vertex of the said annular electrode;

$z_o$ being the distance between the vertex of each said end electrode and the center of the said quistor; and $r_o$ being the distance between the vertex of the said annular electrode and the center of the said quistor.

3. A mass spectrometer according to claim 2, characterized in that of the dimensions of the quistor which determine the distance-related ratio Q, the distance $r_o$ of the vertex of the annular electrode from the center of the said quistor is equal to a value which guarantees that the greatest interesting mass is still trapped by the storage field, at the amplitude of the rf voltage applied to the annular electrode, the distance $z_o$ of the vertex points of the end electrodes from the center of the quistor is equal to $Q\ z_o = r_o/4\sqrt{Q}$, for given ratio Q, and the radii $R_e$ and $R_r$ of the vertex cross-sections are selected in such a manner that $R_e \times R_r = r_o \times z_o$.

* * * * *